US009621996B2

(12) United States Patent
Schelling et al.

(10) Patent No.: US 9,621,996 B2
(45) Date of Patent: Apr. 11, 2017

(54) MICROMECHANICAL SOUND TRANSDUCER SYSTEM AND A CORRESPONDING MANUFACTURING METHOD

(71) Applicant: Robert Bosch GmbH, Stuttgart (DE)

(72) Inventors: Christoph Schelling, Stuttgart (DE); Michael Stumber, Korntal-Muenchingen (DE); Benedikt Stein, Stuttgart (DE); Theresa Lutz, Mannheim (DE); Rolf Scheben, Reutlingen (DE)

(73) Assignee: ROBERT BOSCH GMBH, Stuttgart (DE)

( * ) Notice: Subject to any disclaimer, the term of this patent is extended or adjusted under 35 U.S.C. 154(b) by 0 days.

(21) Appl. No.: 14/793,012

(22) Filed: Jul. 7, 2015

(65) Prior Publication Data

US 2017/0013364 A1 Jan. 12, 2017

(51) Int. Cl.

| | |
|---|---|
| ***H04R 25/00*** | (2006.01) |
| ***H04R 9/04*** | (2006.01) |
| ***H04R 9/02*** | (2006.01) |
| ***H04R 31/00*** | (2006.01) |
| ***H04R 9/08*** | (2006.01) |

(52) U.S. Cl.

CPC ..... *H04R 9/048* (2013.01); *H04R 9/025* (2013.01); *H04R 9/08* (2013.01); *H04R 31/006* (2013.01); *H04R 2201/003* (2013.01); *H04R 2209/024* (2013.01)

(58) Field of Classification Search

CPC ..... H04R 1/28; H04R 1/1041; H04R 1/1091; H04R 1/08; H04R 2430/00

USPC ..... 381/170–176; 336/131; 29/832

See application file for complete search history.

(56) References Cited

U.S. PATENT DOCUMENTS

| | | | | |
|---|---|---|---|---|
| 5,741,316 | A * | 4/1998 | Chen | A61N 1/3787 607/61 |
| 6,434,252 | B1 | 8/2002 | Royer et al. | |
| 8,031,889 | B2 | 10/2011 | Horng et al. | |
| 2011/0123043 | A1* | 5/2011 | Felberer | H04R 19/005 381/94.2 |
| 2011/0235848 | A1* | 9/2011 | Meguro | H04R 7/045 381/400 |

FOREIGN PATENT DOCUMENTS

WO 2006/047048 A2 5/2006

* cited by examiner

*Primary Examiner* — Md S Elahee
*Assistant Examiner* — Julie X Dang
(74) *Attorney, Agent, or Firm* — Gerard Messina

(57) ABSTRACT

A micromechanical sound transducer system and a corresponding manufacturing method, in which the micromechanical sound transducer system includes a substrate having a front side and a back side, the substrate having a through opening extending between the back side and the front side, and a coil configuration on the front side having a coil axis, which runs essentially parallel to the front side, the coil configuration covering the through opening at least partially. Also provided is a magnet device, which is situated so as to allow for an axial magnetic flux to be generated through the coil configuration. The coil configuration has a winding device which has at least first winding sections made from at least one layer of a low-dimensional conductive material, the coil configuration being configured to inductively detect and/or generate sound.

14 Claims, 3 Drawing Sheets

(A-A')

MICROMECHANICAL SOUND TRANSDUCER SYSTEM AND A CORRESPONDING MANUFACTURING METHOD

FIELD OF THE INVENTION

The present invention relates to a micromechanical sound transducer system and a corresponding manufacturing method.

BACKGROUND INFORMATION

Although in principle applicable to any micromechanical sound transducer system, for example loudspeakers and microphones, the present invention and the problem on which it is based are explained with reference to micromechanical microphone systems on silicon basis.

Micromechanical microphone systems may have a sound transducer device integrated on a MEMS chip for converting sound energy into electrical energy, a first electrode deflectable by sound energy and a fixed, perforated second electrode interacting capacitively. The deflection of the first electrode is determined by the difference of the sound pressures in front of and behind the first electrode. If the deflection changes, then the capacitance of the capacitor formed by the first and the second electrode is modified, which measuring technology is able to detect.

Ribbon microphones are believed to have been understood for some time. They function according to an inductive functional principle, the deflection of a diaphragm resulting in a modification of a magnetic flux through a coil configuration, which in turn induces a voltage in the coil configuration.

Because of the induction of a current corresponding to the induced voltage, it is not necessary to generate and regulate a high operating voltage of the capacitive operating principle, which result in a substantial reduction of the power consumption and a cost reduction because of the omission of high-voltage-generating circuit parts.

This yields numerous advantages compared to the capacitive operating principle. Thus it is possible to implement a directional dependency of the ribbon microphone since it is possible to operate it as a differential-pressure microphone. Due to its small power consumption, the inductive principle allows for an always-on and wake-up functionality. The sensitivity scales with the length and number of the ribbons and not, as in the capacitive principle, with the deflection surface. Capacitive MEMS microphones therefore cannot be scaled down without performance losses. Furthermore, there is an increased mechanical robustness due to the low mass of the oscillatory material.

Ribbon microphones are discussed in U.S. Pat. No. 6,434,252 B1 and WO 2006/047048 A2, in which a ribbon located in a magnetic field is excited to oscillate by sound waves, which induces a voltage in the ribbon.

U.S. Pat. No. 8,031,889 B2 discusses a miniaturized ribbon microphone, which has a low sensitivity since the coils are configured in one plane and a voltage is induced only by deflection components in the vertical direction.

SUMMARY OF THE INVENTION

The present invention provides a micromechanical sound transducer system and a corresponding manufacturing method as described herein.

Further embodiments are the subject matter of the further descriptions herein.

The present invention provides a very power-saving miniaturized and sensitive micromechanical sound transducer system. It has a low current consumption since there is no active operation. The micromechanical sound transducer system according to the invention is particularly suitable for always-on applications having a wake-up functionality. Smaller sound transducer system become possible because the scaling behavior differs from that of the capacitive operating principle. A great dynamic range may be achieved due to the low mass of the low-dimensional conductive ribbon material.

The possibility of placing magnetizable layers in the immediate vicinity of the position of rest of the ribbons allows for a high magnetic flux and thus a high magnetic flux modification through the coil configuration when the ribbon is deflected. The utilized novel, low-dimensional materials allow for minimum stiffness and at the same time high breaking stress. Furthermore, the low mass density of the low-dimensional materials allows for a very great dynamic measuring range, particularly towards high frequencies.

According to an exemplary embodiment, the low-dimensional conductive material is one-dimensional or two-dimensional. It is possible to configure such materials to be break-proof and highly elastic.

According to another exemplary embodiment, the low-dimensional conductive material is selected from the following group: graphene, silicene, carbon nano tubes, carbon nano ribbons, divanadium pentaoxide, dichalcogenide, in particular molybdenum disulfide, tungsten disulfide, titanium disulfide, molybdenum disulfide. The deposition processes of these materials are readily controllable.

According to another exemplary embodiment, the first winding sections of the coil configuration are strip-shaped and cover the through opening. Thus it is possible to cover a large area and achieve accordingly a high sensitivity. In order to achieve the greatest possible sensitivity, the air leakage past the ribbons should be as low as possible, i.e., the distance between two ribbons having a common fluid access hole must be as small as possible, and the ribbons should cover the fluid access hole completely laterally.

According to another exemplary embodiment, the first winding sections run above the through opening essentially parallel to the front side. This ensures maximum deflectability by the impinging sound pressure.

According to another exemplary embodiment, the first winding sections extend into the periphery of the through opening above the front side. This makes it possible to provide stable anchoring.

According to another exemplary embodiment, the first winding sections are applied on a diaphragm area that covers the through opening. This increases the ram pressure and therefore the dynamics. The diaphragm area may be formed from a low-dimensional, non-conductive material such as e.g. hexagonal boron nitride.

According to another exemplary embodiment, the first winding sections are followed by second winding sections, which run essentially perpendicular with respect to the front side, the second winding sections being followed by third winding sections, which run essentially in coplanar fashion with respect to the front side at a distance from the first winding sections. It is possible to manufacture such a geometry cost-effectively.

According to another exemplary embodiment, the second and third winding sections are made from a material that differs from the low-dimensional conductive material. A stiff metal is suitable for this purpose for example, which enhances stability.

According to another exemplary embodiment, the third winding sections have perforations for sound to pass through. This makes it possible to reduce the ram pressure behind the first winding areas.

According to another exemplary embodiment, the substrate is attached with its back side on a carrier having a carrier opening, the carrier opening being in fluid communication with the through opening and a cover being attached on the carrier on the front side, which defines an enclosed back volume. Such a back volume reduces undesired damping effects.

According to another exemplary embodiment, the magnet device is situated above the front side on the substrate in the direction of the coil axis and is magnetized. Such a system is simple to manufacture and ensures a great magnetic flux through the coil.

According to another exemplary embodiment, the magnet device is integrated into a wall of the cover in the direction of the coil axis. This reduces the manufacturing expenditure.

According to another exemplary embodiment, the through opening has a cavity on the back side which is followed by a through hole. This makes it possible to form a suitable front volume in order to increase the sensitivity.

In the following, the present invention is explained in greater detail with reference to the exemplary embodiments indicated in the schematic figures of the drawings.

DETAILED DESCRIPTION

In the figures, identical reference symbols denote identical or functionally corresponding elements.

Figure 1A:
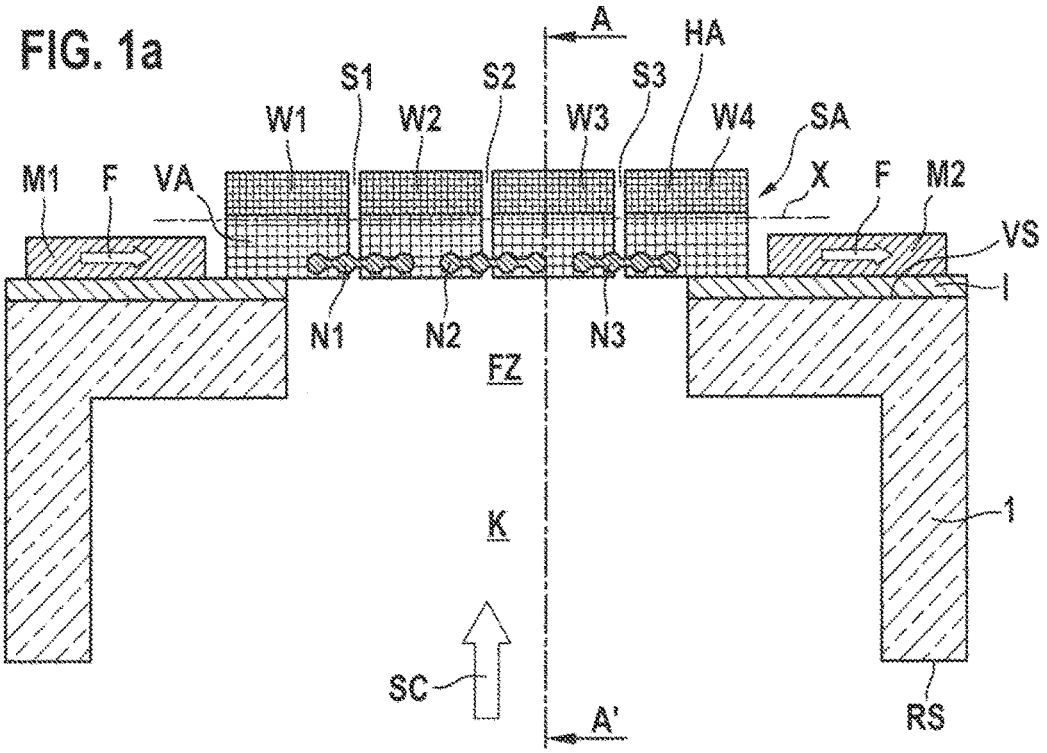
FIGS. 1*a*, 1*b*, and 1*c* show schematic representations of a micromechanical sound transducer system according to a first specific embodiment of the present invention, namely, FIG. 1*a* in a first vertical cross section, FIG. 1*b* in a second vertical cross section along the line A-A', and FIG. 1*c* in a top view.
Figure 1B:
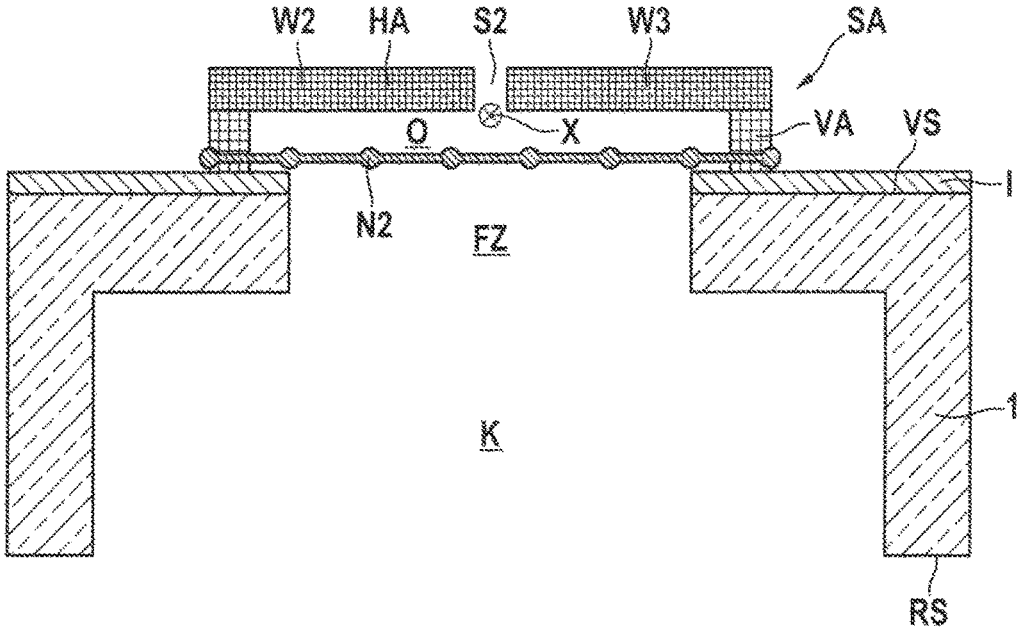
Figure 1C:
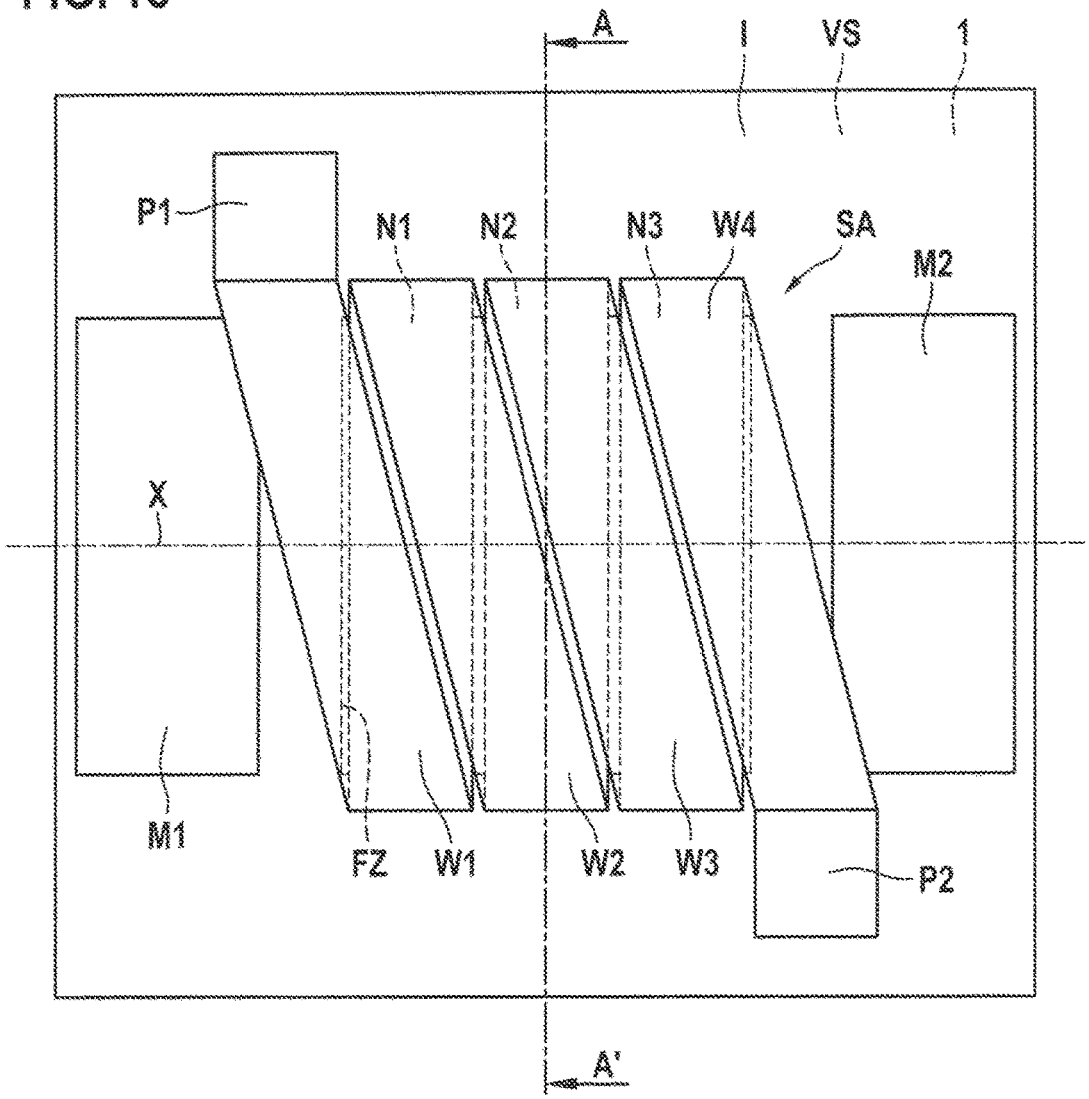

FIGS. 1*a*)-*c*) show schematic representations of a micromechanical sound transducer system according to a first specific embodiment of the present invention, namely, FIG. 1) in a first vertical cross section, FIG. 1*b*) in a second vertical cross section along the line A-A', and FIG. 1*c*) in a top view.

In FIGS. 1*a*)-*c*), reference numeral 1 indicates a substrate having a front side VS and a back side RS, which is formed for example from a semiconductor material (e.g. silicon), glass or ceramics. Substrate 1 has a through opening K, FZ extending between back side RS and front side VS, which includes a cavity K on the back side and an adjacent through hole FZ. It is possible to configure such a substrate geometry by a known back side etching process using appropriate etch stop layers.

On the front side VS, in the periphery of through hole FZ, there is an insulating layer I, made of an oxide for example. Above insulating layer I, a coil configuration SA is configured having a coil axis X, which runs essentially in parallel to the front side VS, the coil configuration SA covering the through hole FZ of through opening K, FZ. The coil configuration has a winding device having a plurality of windings W1, W2, W3, W4, which have first winding sections N1, N2, N3 made of at least one layer of a low-dimensional conductive material.

The low-dimensional conductive material is for example graphene, silicene, divanadium pentaoxide, carbon nano tubes, carbon nano ribbons, a dichalcogenide, in particular molybdenum disulfide, tungsten disulfide, titanium disulfide, molybdenum dioxide, or the like.

The first winding sections N1, N2, N3 are anchored above front side VS on insulating layer I and cover through hole FZ almost completely except for small gaps S1, S2, S3 between the individual windings W1, W2, W3, W4.

First winding sections N1, N2, N3 are followed by second winding sections VA, which run essentially perpendicular with respect to front side VS, and second winding sections VA are followed by third winding sections HA, which run essentially in a coplanar manner with respect to front side VS at a distance from first winding sections N1, N2, N3. An opening O of coil configuration SA is thereby defined. The material of the second and third winding sections VA, HA is made of a material that differs from the low-dimensional conductive material, for example from metal such as e.g. nickel. Such a coil geometry may be manufactured by deposition processes combined with sacrificial layer processes.

Permanent magnet areas M1, M2, which produce an axial magnetic flux F through coil configuration SA, are configured on the longitudinal ends of coil configuration SA in the direction of coil axis X. These permanent magnet areas M1, M2 may be manufactured by deposition and subsequent structuring of a suitable permanent-magnetic or ferromagnetic material.

If sound SC enters through the through opening K, FZ, then the first winding sections N1, N2, N3 are deflectable by this sound SC, and a corresponding voltage is induced in coil configuration SA, which is able to be tapped at terminal pads P1, P2, which are connected to the ends of coil configuration SA. In the present example, the first, second and third winding sections N1, N2, N3, VA, HA are configured in strip-shaped fashion so as to be able to cover a large area with small gaps S1, S2, S3. This increases the sensitivity of the sound transducer system.

A corresponding evaluation ASIC is not shown and may also be integrated on the substrate for example or in a separate chip.

Figure 2:
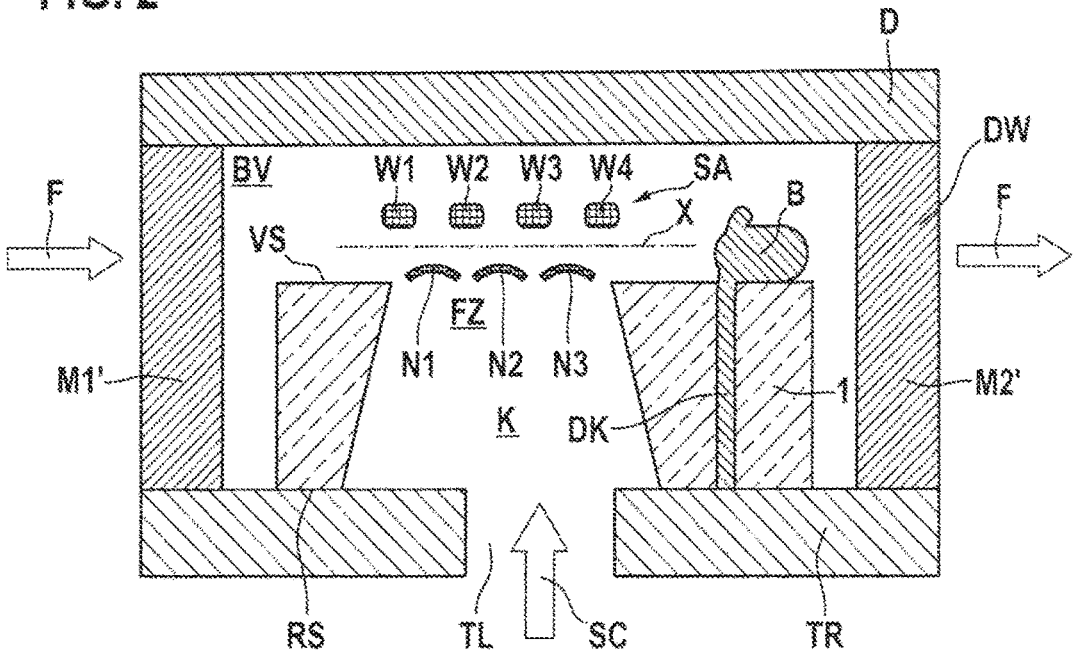
FIG. 2 shows a schematic vertical cross-sectional representation of a micromechanical sound transducer system according to a second specific embodiment of the present invention.

FIG. 2 shows a schematic vertical cross-sectional view of a micromechanical sound transducer system according to a second specific embodiment of the present invention.

In the second specific embodiment as shown in FIG. 2, substrate 1 is configured in accordance with the first specific embodiment, coil configuration SA being indicated only schematically, and is attached on a carrier TR having a carrier opening TL, the carrier opening being in fluid communication with the through opening so that sound SC is able to reach coil configuration SA from outside through carrier opening TL and through opening K, FZ. A cover D is attached on carrier TR above front side VS, which cover defines an enclosed back volume BV above front side VS. Such a back volume BV is advantageous in order to reduce unwanted damping effects. The permanent magnetization likewise points in the direction of coil axis X.

In this specific embodiment, magnet device M1', M2' is integrated into a wall DW of cover D in the direction of coil axis X, for example by insertion of a suitable ferromagnetic material.

Additionally, there is an indication in substrate 1 of the second specific embodiment of a continuous contact DK with a bond area B on the front side of substrate 1, which may be used to establish en electrical connection to carrier TR.

Figure 3:
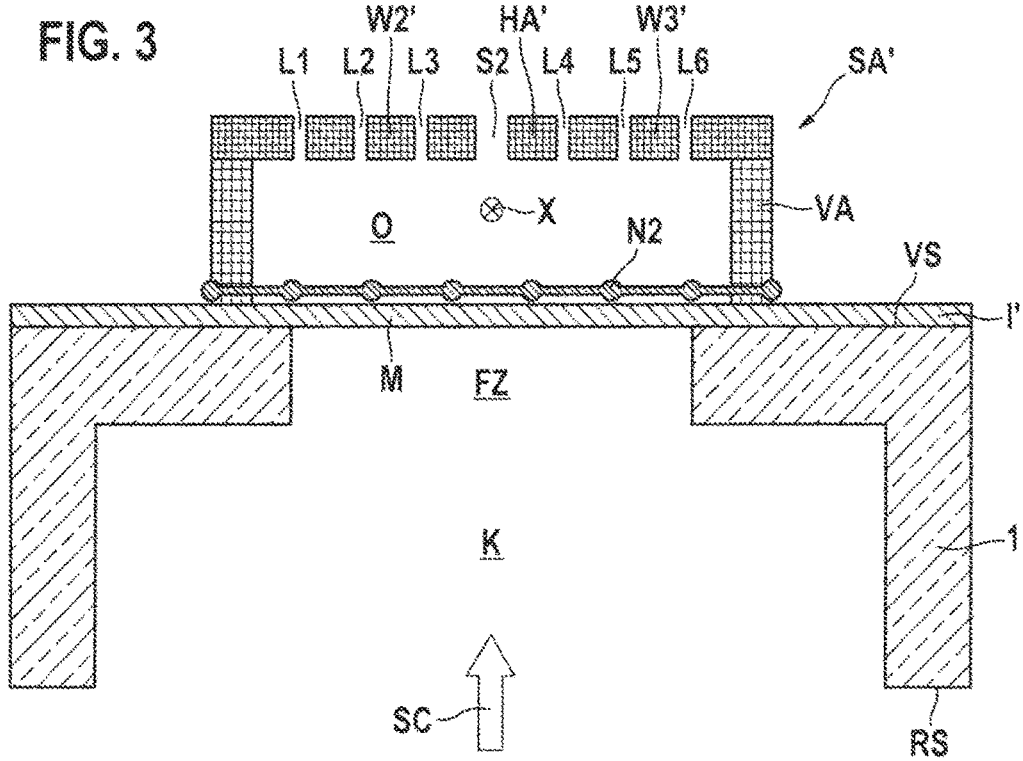
FIG. 3 shows a schematic vertical cross-sectional representation of a micromechanical sound transducer system according to a third specific embodiment of the present invention.

FIG. 3 shows a schematic vertical cross-sectional view of a micromechanical sound transducer system according to a third specific embodiment of the present invention.

In the third specific embodiment as shown in FIG. 3, the insulating layer is designated by reference symbol I'. It forms a diaphragm area M over through hole FZ of through opening K, FZ, which covers through hole FZ. In this specific embodiment, first winding sections N1, N2, N3 are supported by diaphragm area M, diaphragm area M being deflectable by sound SC. This makes it possible to generate more ram pressure for the sound SC. In this specific embodiment, third winding sections HA' of windings W2', W3' are additionally provided with perforations L1 through L6 for sound to pass through, which reduces the ram pressure forming behind diaphragm region M so that the dynamics are increased.

In other respects, the third specific embodiment is configured identically to the first specific embodiment.

Although the present invention was described completely above with reference to the exemplary embodiments, it is not limited to these, but may be modified in numerous ways.

Particularly the shown geometries and materials are only exemplary and may be varied nearly at will depending on the application.

Although in the above specific embodiments, the magnet device is made of a ferromagnetic material, it is not limited to this, but could also be implemented by an electromagnetic coil device.

The present invention is also not limited to microphones, but is also applicable to other sound transducers such as e.g. loudspeakers.

The invention claimed is:

1. A micromechanical sound transducer system, comprising:

a substrate having a front side and a back side, and having a through opening extending between the back side and the front side;

a coil configuration having a coil axis on the front side, which essentially runs parallel to the front side, the coil configuration at least partially covering the through opening;

a magnet device situated so as to allow an axial magnetic flux through the coil device to be generated;

wherein the coil configuration includes a winding device having at least first winding sections made of at least one layer of a low-dimensional conductive material, wherein the first winding sections are strip-shaped and cover the through opening, and wherein the coil configuration is configured so as to be able inductively to at least one of detect sound and produce sound.

2. The micromechanical sound transducer system of claim 1, wherein the low-dimensional conductive material is one-dimensional or two-dimensional.

3. The micromechanical sound transducer system of claim 1, wherein the low-dimensional conductive material is selected from at least one of the following: graphene, silicene, divanadium pentaoxide, carbon nano tubes, carbon nano ribbons, dichalcogenide.

4. The micromechanical sound transducer system of claim 1, wherein the first winding sections above the through opening run essentially in a coplanar manner with respect to the front side.

5. The micromechanical sound transducer system of claim 1, wherein the first winding sections extend into a periphery of the through opening above the front side.

6. The micromechanical sound transducer system of claim 4, wherein the first winding sections are applied on a diaphragm region, which covers the through opening.

7. The micromechanical sound transducer system of claim 1, wherein the first winding sections are followed by second winding sections, which run essentially perpendicular to the front side, and wherein the second winding sections are followed by third winding sections, which run essentially in a coplanar manner with respect to the front side and at a distance from the first winding sections.

8. The micromechanical sound transducer system of claim 1, wherein the second winding sections and the third winding sections are manufactured from a material that differs from the low-dimensional conductive material.

9. The micromechanical sound transducer system of claim 1, wherein the third winding sections have perforations for sound to pass through.

10. The micromechanical sound transducer system of claim 1, wherein the substrate is attached with its back side on a carrier having a carrier opening, which is in fluid communication with the through opening, and wherein a cover is attached on the carrier above the front side, which defines an enclosed back volume.

11. The micromechanical sound transducer system of claim 1, wherein the magnet device is situated above the front side on the substrate in the direction of the coil axis.

12. The micromechanical sound transducer system of claim 1, wherein the magnet device is integrated in a wall of the cover in the direction of the coil axis.

13. The micromechanical sound transducer system of claim 1, wherein the through opening has on the back side a cavity and connected to it a through hole.

14. The micromechanical sound transducer system of claim 1, wherein the low-dimensional conductive material is selected from at least one of the following: graphene, silicene, divanadium pentaoxide, carbon nano tubes, carbon nano ribbons, dichalcogenide, in particular molybdenum disulfide, tungsten disulfide, titanium disulfide, and molybdenum dioxide.

* * * * *